US005375739A

United States Patent [19]

Granfelt

[11] Patent Number: 5,375,739

[45] Date of Patent: Dec. 27, 1994

[54] APPARATUS FOR CONTROL OF DELIVERY OF LIQUIDS

[76] Inventor: Claes Granfelt, Kallbacken 16, S-126 57 Hagersten, Sweden

[21] Appl. No.: 969,328

[22] Filed: Oct. 30, 1992

[51] Int. Cl.[5] ..... B67D 3/00

[52] U.S. Cl. ..... 222/56; 222/64; 222/510; 222/518; 137/396; 141/198

[58] Field of Search ..... 222/55, 64, 510, 479, 222/513, 514, 518, 500, 56, 481; 141/95, 324, 198; 137/406, 407, 396, 403

[56] References Cited

U.S. PATENT DOCUMENTS

| | | | |
|---|---|---|---|
| 998,856 | 7/1911 | Mitchell | 137/403 X |
| 1,349,078 | 8/1920 | Maddox | 137/396 |
| 1,669,271 | 5/1928 | Webb | 137/396 |
| 1,744,266 | 1/1930 | Halyburton | 137/396 |
| 3,242,941 | 3/1966 | Palmore | 137/396 |
| 4,773,797 | 9/1988 | Merz | 141/198 X |
| 4,869,405 | 9/1989 | Rudick | 222/518 |
| 5,123,569 | 6/1992 | Lindner | 222/56 |

*Primary Examiner*—Andres Kashnikow

*Assistant Examiner*—Anthoula Pomrening

*Attorney, Agent, or Firm*—Hodgson, Russ, Andrews, Woods & Goodyear

[57] ABSTRACT

In a control apparatus for measuring, mixing or regulating one or more liquids in some other way, the liquid or liquids is/are delivered to a vessel (1) through delivery pipes (3, 4). The vessel includes a container (2) having a spillway (8). Liquid which passes over the lid of the spillway is collected by a liquid-collecting device (9) connected to a container outlet valve (7) by means of an arm (12) which is subjected to the load of a spring (13). When the weight of the liquid collected in the device (9) exceeds the force exerted by the spring, the outlet valve will open. At the same time there is activated, for instance, a microswitch (17) which influences the supply of liquid through the delivery pipes (3, 4). The liquid-collecting device has a constricted outlet (11) and when the liquid collected by the device (9) has drained therefrom, the spring (13) will return the outlet valve (7) to its closed position and the microswitch is operated so as to enable further liquid to be delivered from the delivery pipes.

9 Claims, 3 Drawing Sheets

APPARATUS FOR CONTROL OF DELIVERY OF LIQUIDS

TECHNICAL FIELD

The present invention relates to the control of the flow of a liquid to and/or from a vessel which includes a container to which at least one delivery line extends.

BACKGROUND ART

It is known to measure individual liquids in predetermined quantities or to mix two or more liquids to predetermined ratios for different purposes. To this end, there is normally used a measuring or mixing vessel to which one or more liquid delivery lines extend. With the intention of obtaining desired quantities of liquid, it is it is known to use more or less complicated control devices and control circuits which function to control said control devices and which in turn are influenced by the liquid present in the vessel. Hitherto, relatively qualified control equipment which includes communicating vessels, solenoid valves and/or complicated control systems have been required in order to achieve an adequately accurate result.

DISCLOSURE OF THE INVENTION

One object of the present invention is to provide an apparatus which includes simple, but nevertheless accurate and reliable control means, preferably fully operable unpowered means.

This is achieved by providing the apparatus container with a spillway or an overflow means which discharges into a liquid-collecting device which upon collecting a predetermined amount or weight of liquid will cause an outlet valve in the container to open. Thus, the liquid delivered by the delivery line or lines will reach a given level in the container and the liquid-collecting device will then begin to collect "overflow liquid". When this "overflow liquid" reaches a predetermined volume, the liquid-collecting device will cause the outlet valve in the container to open, therewith the container is drained of liquid, to a greater or lesser extent.

Further advantages are afforded by a further development of the inventive arrangement, without detracting from the simplicity and reliability of the arrangement.

DESCRIPTION OF PREFERRED EMBODIMENTS

The present invention will now be described in more detail with reference to the accompanying drawings.

Figure 1:
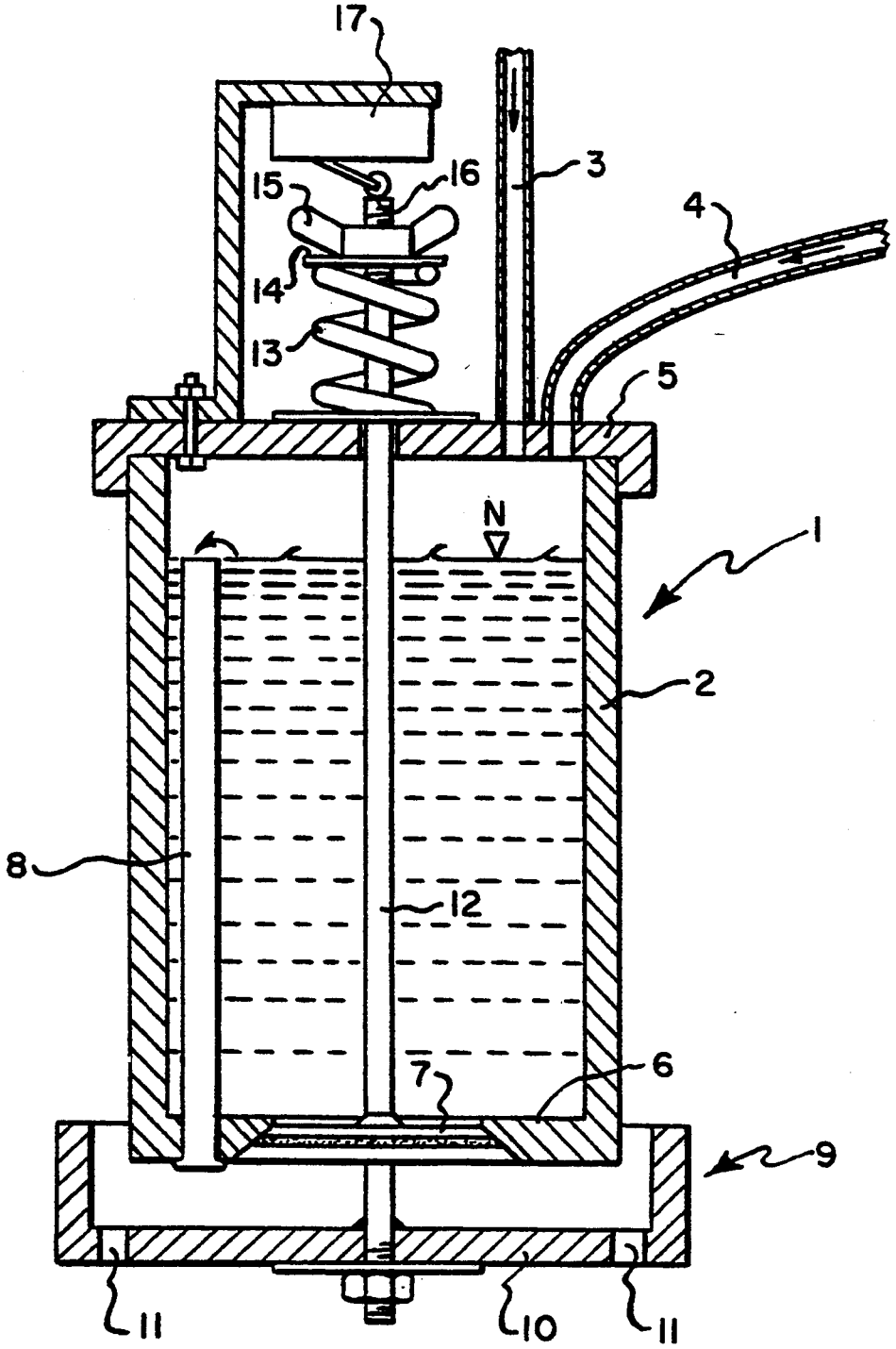
Figure 2:
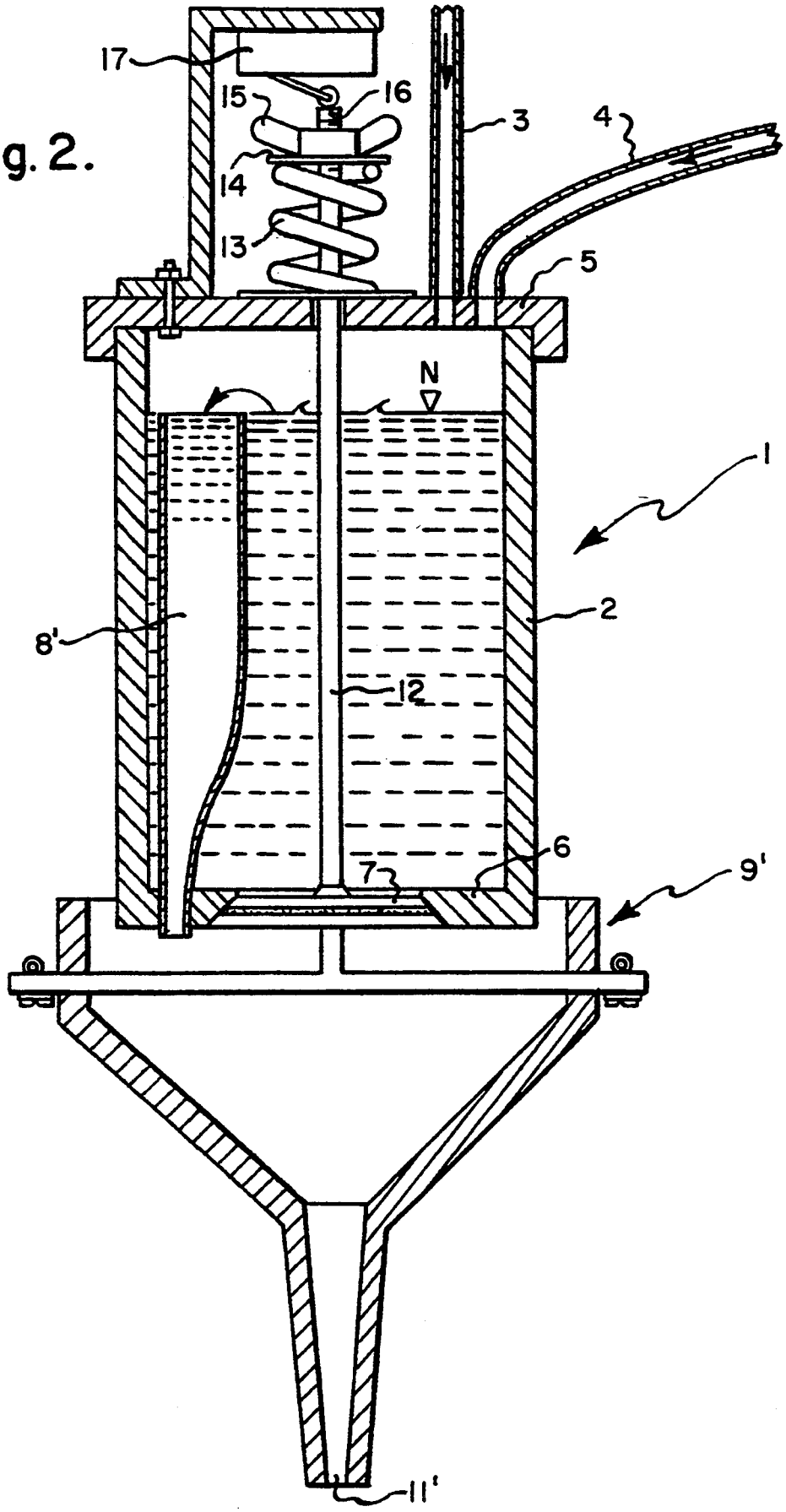

FIGS. 1 and 2 of which are schematic, longitudinal sectional views of two embodiments of the inventive control arrangement.

FIG. 1 is a longitudinal sectional view of a vessel 1 which includes a container 2. Leading to the container 2 are two liquid delivery pipes, or hoses, 3, 4, the liquids delivered being mixed together for instance, or at least measured in the vessel 1. The delivery pipes 3, 4 terminate in the cap 5 of the container 2. The container 2 also comprises a bottom 6 in which an outlet valve 7 is fitted.

Mounted in the container 2 is a spillway 8 which has the form of a tube whose discharge orifice is located either above or within the confines of a liquid-collecting device 9. In the case of the illustrated embodiment, the liquid-collecting device 9 comprises a cup or basin-shaped vessel which has constricted outlets 11 provided in the bottom 10 thereof.

The liquid-collecting device 9 is joined to the outlet valve 7 by means of a link device 12, in the illustrated case, an arm. The arm 12 extends through the container 2 and up through the container cap 5, and the part of the arm which protrudes above the cap has an arm biasing spring 13 fitted thereto. The arm 12, the liquid-collecting device 9 and the valve 7 can thus be moved in the length direction (vertical in the Figure) in dependence on the spring force. The spring 13 is held tensioned between the upper surface of the cap 5 and a plate 14 by means of a wing nut 15 which can be screwed along a screw thread 16 cut in the end part of the arm 12 that protrudes above the cap 5. This enables the force of the spring to be adjusted.

In the illustrated embodiment, the cap 5 also carries a binary switch function, for instance, an electric microswitch 17, which is actuable by the end surface of the arm 12.

Figure 1A:
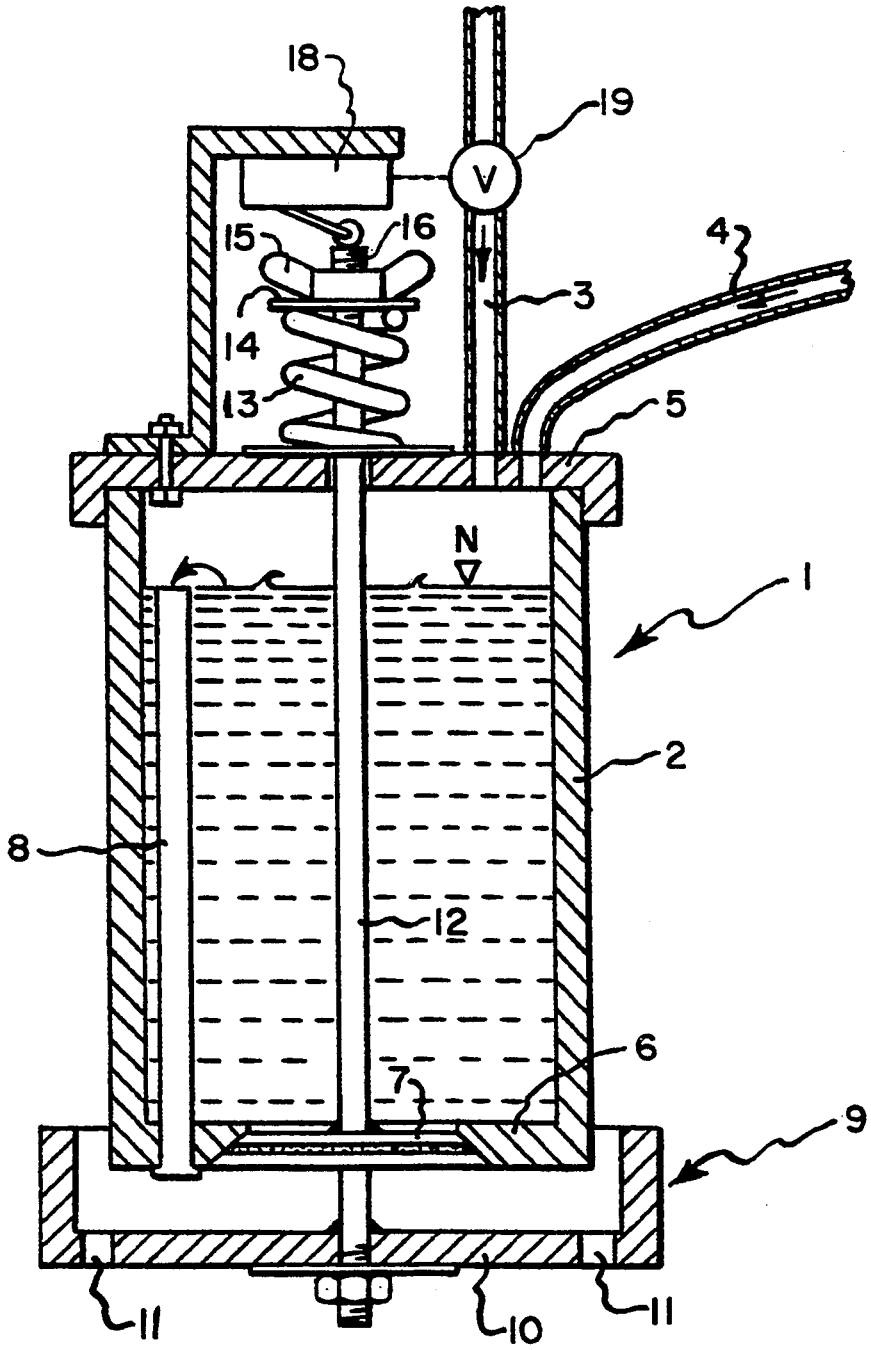

This microswitch 17 can be caused to operate solenoid control valves incorporated in one or both of the delivery pipes 3, 4. Alternatively, arm 12 can coact with a valve control device 18 for manipulation of a feed valve 19 mounted in the delivery line 3 as shown in FIG. 1A.

FIG. 2 shows a modified embodiment of the inventive control arrangement having a liquid-collecting device 9' taking the shape of a funnel, e.g. suitable for filling of bottles. Thus, the number of outlets is restricted to one 11' only.

Furthermore the spillway 8' is designed to have a larger area at the inlet end thereof than is the case at the outlet end. However, it is important that the outlet of the spillway 8' (which also is true for the embodiment shown in FIG. 1) has an area being sufficiently large for obtaining a reliable function.

The illustrated inventive control apparatus of the present invention as shown in the FIGS. operates in the following manner. Liquid or liquids is/are delivered to the container 2 through one or both delivery pipes 3, 4. When the liquid level N reaches the edge of the spillway 8 or 8', liquid will flow into the liquid-collecting device 9 or 9'. When the device 9, 9' has collected so much liquid that its weight exceeds the spring force (spring 13) preset with the aid of the nut 15, the outlet valve 7 will open. At the same time, the microswitch 17 is activated so as to interrupt the delivery of liquid through the pipes 3, 4.

Because of the presence of the constricted outlet 11 or 11' in the respective liquid-collecting device 9 and 9', the outlet valve 7 will remain open over a predetermined length of time. When the liquid collected by the device 9 or 9' has drained through the outlets 11 or outlet 11', the force exerted by the spring 13 will overcome the force exerted by the weight of the liquid-collecting device 9 or 9' and therewith close the valve 7. In conjunction herewith, the microswitch 17 is activated so as to cause liquid to be delivered to the container through one or both of the delivery pipes 3, 4.

As will be understood, the aforedescribed and illustrated embodiments of the inventive control apparatus may be modified in various ways within the scope of the invention.

The described and illustrated embodiment includes an outlet valve 7, a spillway 8 or 8' and a liquid-collecting device 9 or 9'. It will be understood, however, that several such components may be mounted in one and the same container 2. For example, a liquid-collecting device may be caused to control several outlet valves 7. Another conceivable modification is one in which several liquid-collecting devices 9 or 9', each controlling its associated outlet valve 7, are arranged to activate said associated valves at different time points. This can be achieved with different spring force settings, different spillway areas, and like measures.

Furthermore, the illustrated embodiments 9 and 9' of the liquid-collecting device can be mounted outside of the container 2. The spillway 8 and 8' may be made vertically adjustable. The spillway may also take other forms than the illustrated tube form. The link device 12 need not necessarily be an arm, since the function of the device can be achieved with other link devices, although the illustrated arm is preferred at present. The delivery pipes 3, 4 may be a single pipe or more than the two illustrated pipes, and the microswitch 17 may be omitted completely or replaced with analog or mechanical equivalents. The present invention shall not therefore be considered restricted to the illustrated exemplifying embodiment thereof, since the inventive concept as defined in the following claims includes several conceivable alternatives and modifications.

I claim:

1. Apparatus for controlling the flow of liquid to and from a vessel (1) including a container (2) having at least one delivery line (3,4), said container (2) including at least one spillway (8;8') discharging into a liquid collecting device (9;9') which upon collecting a predetermined quantity of liquid causes one or more outlet valves (7) in the container (2) to open in the direction of liquid flow, said liquid-collecting device (9;9') being mechanically connected to the one or more outlet valves (7) through the intermediary of a link device (12) having the shape of an arm which extends between the liquid-collecting device (9;9') and the one or more outlet valves (7) and which is acted upon by a force generating device (13) intended to counteract the weight of the liquid in the liquid-collecting device (9;9'), said arm coacting with an electrical or mechanical valve control device (17) for manipulation of a feed valve mounted in the at least one delivery line (3,4), said apparatus operating as a controlled dump valve with linear action and repetitive operation.

2. Apparatus according to claim 1, characterized in that the liquid-collecting device (9;9') has at least one constricted outlet (11;11').

3. Apparatus according to claim 1, characterized in that the level of the at least one spillway (8) in the container (2) can be adjusted.

4. Apparatus for controlling the flow of liquid to and from a vessel (1) including a container (2) having at least one delivery line (3,4), said apparatus operating as a predetermined volume controlled dump valve with linear action and repetitive operation, said container (2) including at least one spillway (8;8') discharging into a liquid-collecting device (9;9') which upon collecting a predetermined quantity of liquid causes one or more outlet valves (7) in the container (2) to open in the direction of liquid flow, the liquid-collecting device (9;9') being connected mechanically to the one or more outlet valves (7) through the intermediary of a link device (12) which is biased by a force-generating device (13) intended to counteract the weight of the liquid in the liquid-collecting device, the link device being an arm (12) which extends between the liquid-collecting device (9;9') and the one or more outlet valves (7) and which is acted upon by the force generating device (13), the one or more outlet valves (7) being mounted in a container bottom (6); and said arm (12) further extending to a container cap (5) on which said force-generating device comprising a spring (13) is intended to exert an adjustable force on the arm.

5. Apparatus according to claim 4, characterized in that the liquid-collecting device (9;9') is a cup-shaped or funnel-shaped vessel positioned beneath the container bottom (6); in that the arm (12) which is attached to the cup- or funnel-shaped vessel extends through the one or more outlet valves (7) and is attached thereto and further extends up through the container (2) and freely through and above the container cap (5), where the part of the arm protruding above the cap is surrounded by the spring (13), said spring being seated between the upper surface of the cap and a plate (14) fitted to the arm.

6. Apparatus according to claim 5, characterized in that the part of the arm (12) protruding above the cap (5) is provided with a screw thread (16), and that the position of the plate (14) can be adjusted by means of a setting nut (15) coacting with said screw thread, so as to adjust the force exerted by the spring.

7. Apparatus for controlling the flow of liquid to and from a vessel (1) including a container (2) having at least one delivery line (3,4), said apparatus operating as a predetermined volume controlled dump valve with linear action and repetitive operation, said container (2) including at least one spillway (8;8') discharging into a liquid-collecting device (9;9') which upon collecting a predetermined quantity of liquid causes one or more outlet valves (7) in the container (2) to open in the direction of the liquid flow, the liquid-collecting device (9;9') having at least one constricted outlet (11;11'), the one or more outlet valves (7) intended to close when the amount of liquid in said device (9;9') lies beneath a minimum level, the liquid-collecting device (9;9') being connected mechanically to the one or more outlet valves (7) through the intermediary of a link device (12) which is biased by a force-generating device (13) intended to counteract the weight of the liquid in the liquid-collecting device, the link device being an arm (12) which extends between the liquid-collecting device (9;9') and the one or more outlet valves (7) and which is acted upon by the force generating device (13), the arm (12) coacting with an electrical or mechanical valve control device (17) for manipulation of a feed valve mounted in the at least one delivery line (3,4).

8. Apparatus for controlling the flow of liquid to and from a vessel (1) including a container (2) having at least one delivery line (3,4), said apparatus operating as a predetermined volume controlled dump valve with linear action and repetitive operation, said container (2) including at least one spillway (8;8') discharging into a liquid-collecting device (9;9') which upon collecting a predetermined quantity of liquid causes one or more outlet valves (7) in the container (2) to open in the direction of liquid flow, the liquid-collecting device (9;9') being connected mechanically to the one or more outlet valves (7) through the intermediary of a link device (12) which is biased by a force-generating device (13) intended to counteract the weight of the liquid in the liquid-collecting device, the link device being an arm (12) which extends between the liquid-collecting device (9;9') and the one or more outlet valves (7) and which is acted upon by the force generating device (13), the arm (12) coacting with an electrical or mechanical valve control device (17) for manipulation of a feed valve mounted in the at least one delivery line (3,4).

9. Apparatus according to claims 7 or 2 characterized in that the valve control device (17) is a binary or analog function device which is connected in a manner controlling the feed valve in the at least one delivery line (3,4).

* * * * *